US006415782B1

(12) United States Patent
Holland

(10) Patent No.: US 6,415,782 B1
(45) Date of Patent: Jul. 9, 2002

(54) MOUNT FOR BALL PITCHING DEVICES

(76) Inventor: Charles T. Holland, 2120 Quarterhouse Cir. East, Jacksonville, FL (US) 32259

( * ) Notice: Subject to any disclaimer, the term of this patent is extended or adjusted under 35 U.S.C. 154(b) by 0 days.

(21) Appl. No.: 09/696,464

(22) Filed: Oct. 25, 2000

(51) Int. Cl.[7] ..... F41B 4/00
(52) U.S. Cl. ..... 124/78; 124/6; 124/80
(58) Field of Search ..... 124/6, 78, 80

(56) References Cited

U.S. PATENT DOCUMENTS

| | | | | |
|---|---|---|---|---|
| 3,277,879 A | | 10/1966 | Sayette | |
| 3,421,491 A | | 1/1969 | Brown | |
| 3,568,653 A | | 3/1971 | Earle, Jr. et al. | |
| 3,757,759 A | | 9/1973 | Haworth | |
| 4,140,097 A | | 2/1979 | Lewis | |
| 4,442,823 A | * | 4/1984 | Floyd et al. | 124/78 |
| 5,125,653 A | * | 6/1992 | Kovacs et al. | 124/78 X |
| 5,437,261 A | | 8/1995 | Paulson et al. | |
| 5,464,208 A | | 11/1995 | Pierce | |

* cited by examiner

*Primary Examiner*—John A. Ricci
(74) *Attorney, Agent, or Firm*—Thomas C. Saitta

(57) ABSTRACT

A mount for a ball pitching machine, where the mount automatically and randomly varies the trajectory and direction of the pitched ball, the mount having a pair of motors which rotate crank wheels to which are connected tie rods, the tie rods being connected to amounting post which tilts about a horizontal pivot axis and which rotates about a vertical pivot axis. The amount of tilt and rotation is adjustable within set parameters.

20 Claims, 3 Drawing Sheets

MOUNT FOR BALL PITCHING DEVICES

BACKGROUND OF THE INVENTION

This invention relates generally to the field of projector or throwing devices used to deliver objects through the air, such as baseballs, softballs, tennis balls, footballs, skeet traps, etc. and less generally to mounts or stands used to support the throwing devices. More particularly, the invention relates to such devices used to deliver the objects to varied locations or with varied trajectories, and even more particularly to such devices where the objects are delivered in a randomly variable manner.

Hitting a pitched baseball or softball is an art which improves with repetitive practice. In order to optimize the swing mechanics for a game situation, it is best for batters to hit hundreds of practice pitches. It is important when practicing that the balls be accurately delivered on a consistent basis, and to this end powered pitching machines have been developed which deliver balls without the need for a human pitcher. While some devices utilize mechanical arms or pneumatic delivery systems, the most common systems in use today use one or a pair of rotating wheels to impart velocity to the ball. The pitching machines can be utilized with baseballs or softballs, and for either fast pitch softball or slow pitch softball. The pitching machines can also be set to deliver different types of pitches, i.e., fast balls, curves, sliders, etc. The pitching machines are designed to deliver the ball to virtually the same location every throw, thereby enabling the coach and batter to work on specific skills, such as proper swing mechanics, hitting inside or outside pitches, hitting high or low pitches, etc.

A major problem with standard pitching machines results from this ability to deliver a ball to virtually the same location every pitch. Such practice pitching is completely opposite from game situations, where pitches will vary as to location and trajectory. The standard pitching machines are therefore negative practice aids with regard for identifying and reacting to a pitch which may come inside, outside, high or low, or which may not cross the plate at all and should not be swung at.

To address this problem, pitching or throwing machines have been developed which add variation to the projection direction or height using an oscillating mechanism of some sort. For example, Brown in U.S. Pat. No. 3,421,491 shows a trap throwing device with an oscillating drive mechanism which incorporates a piston to add a random factor to the horizontal movement of the oscillating mechanism in order to prevent the shooters from being able to time the lateral movement of the device. Lewis in U.S. Pat. No. 4,140,097 and Hayworth in U.S. Pat. No. 3,757,759 show a wheeled tennis ball projecting device where the entire unit oscillates laterally. Earle, Jr. et al. in U.S. Pat. No. 3,568,653 shows a tennis ball projecting device which is pre-programmed to vary the angle of delivery. Sayette in U.S. Pat. No. 3,277,879 shows a pitching machine with regular varied changes in direction. Pierce in U.S. Pat. No. 5,464,208 shows a computer controlled pitching machine. Paulson et al. in U.S. Pat. No. 5,437,261 shows a pitching machine with manual adjustment about horizontal and vertical axes. All the above devices suffer from one or more problems, either in that they are only variable about a single pivot axis, are only variable manually, are only variable in regular intervals, have no ability to randomize the pitch, have complicated movement mechanisms, require computer control, and most importantly, are not able to be used with standard pitching machines, necessitating that the entire unit be purchased to obtain the desired results.

It is an object of this invention to provide a mount for a ball pitching machine which automatically and randomly varies the direction and trajectory of the pitched ball about a horizontal pivot axis and a vertical pivot axis, such that the ball is delivered within a predetermined area. It is a further object to provide such a mount where the delivery is adjustable within various parameters to control the area to which the pitches are delivered and to account for variation in pitching distances. It is a further object to provide such a mount which is universal in its ability to be utilized in conjunction with the majority of pitching machines in use today.

SUMMARY OF THE INVENTION

In general, the invention is a mount or support means for a ball throwing or pitching device which variably controls the delivery orientation of the ball pitching device, or an integral pitching device incorporating the mount, primarily used to deliver a baseball or softball across the plate for batting practice. The invention may also be utilized with other object projecting devices, such as tennis ball projecting devices. The invention randomly varies the vertical orientation of the ball pitching means about a horizontal pivot axis in a tilting manner such that the vertical trajectory or arc of the ball is varied for each ball pitched, thereby delivering balls which vary in height as they cross the plate. In the preferred embodiment, the invention also randomly varies the horizontal orientation of the ball pitching means about a vertical pivot axis in a rotating manner such that the direction of each ball pitched is varied, thereby delivering balls which range from the inside to the outside of the plate. The amount of variation in the vertical or horizontal direction is adjustable within parameters, whereby the degree of tilt and the degree of rotation can be made greater or smaller such that the target area for delivery of the balls can be increased or decreased.

The ball pitching device can be set to deliver pitches in the same direction but with randomly varying arcs or height location, i.e., high to low over the same lateral location on the plate, can be set to deliver pitches in randomly varying horizontal directions but with a fixed arc or trajectory, i.e., inside to outside but at the same height over the plate, and can be set to deliver pitches in varying horizontal directions and in varying arcs, i.e., both inside to outside and high to low relative to the plate. Furthermore, the ball pitching device can be set to deliver all pitches within the strike zone, all pitches outside of the strike zone, or pitches both within and outside the strike zone.

The invention in the preferred embodiment is a mount for supporting a ball pitching machine and comprises in general a sturdy base member which houses the drive means for varying the pitch trajectory and direction. The drive means manipulates a vertical post mounted within the base member which is mounted such that it tilts in a vertical arc about a horizontal pivot axis to alter the trajectory of the pitch and rotates about a vertical pivot axis to alter the direction of the pitch. The pitching means is mounted onto the post, such that the balls delivered from the pitching means are randomly projected in different trajectories and directions. The drive means comprise a first and second motor which rotate a first and second crank wheel. A first and second tie rod is connected to each crank wheel in an eccentric manner. The first tie rod is joined to the mounting post. The second tie rod is connected at approximately 90 degrees to a transfer arm which is connected to the mounting post. The mounting post is mounted in a pivoting manner to the support base. The mounting post is further adapted to be rotatable about it central axis. The first motor, crank wheel and tie rod assembly is oriented such that it tilts or pivots the mounting post along a vertical plane in the main pitching direction. The second motor, crank wheel and tie rod assembly rotates the mounting post to alter the pitching direction. The point of connection of the tie rods to the crank wheels is adjustable, such that the stroke length of the tie rods is adjustable, which in turn varies the possible range of travel of the mounting post in either the tilting or rotational direction in order to vary the size of the area within which the balls are delivered.

DETAILED DESCRIPTION OF THE INVENTION

With reference to the illustrations, the invention will now be described in detail with regard for the best mode and the preferred embodiments. In general, the invention is a support or mount device adapted for use with a standard ball pitching device, where the delivery trajectory and direction of the pitched ball are automatically randomly varied, and further where the trajectory can be varied independently of the direction, where the direction can be varied independently of the trajectory, and where the amount of variation is adjustable within predetermined limits. In the alternative, the invention may comprise an object throwing or projecting device, and more directly a baseball or softball ball pitching device, where the mount is incorporated as an integral part of the pitching device.

For purposes herein, the invention will be described with reference to delivering a ball over home plate within a strike zone for a batter. The terms arc or trajectory shall be taken to refer to the path of the ball in a vertical plane extending from the pitching machine to the plate, such that variation of the pitching machine about a horizontal pivot axis alters the arc or trajectory and changes the height at which the ball crosses the plate. The term direction when used in conjunction with a pitched ball shall be taken to refer to the location of the ball laterally relative to the vertical plane, such that variation in the direction of the pitching machine about a vertical pivot axis changes the lateral location of the ball as it crosses the plate, from inside to outside. The term target zone shall be taken to refer to the rectangular region over the plate within which it is desired that all the balls be pitched.

Figure 1:
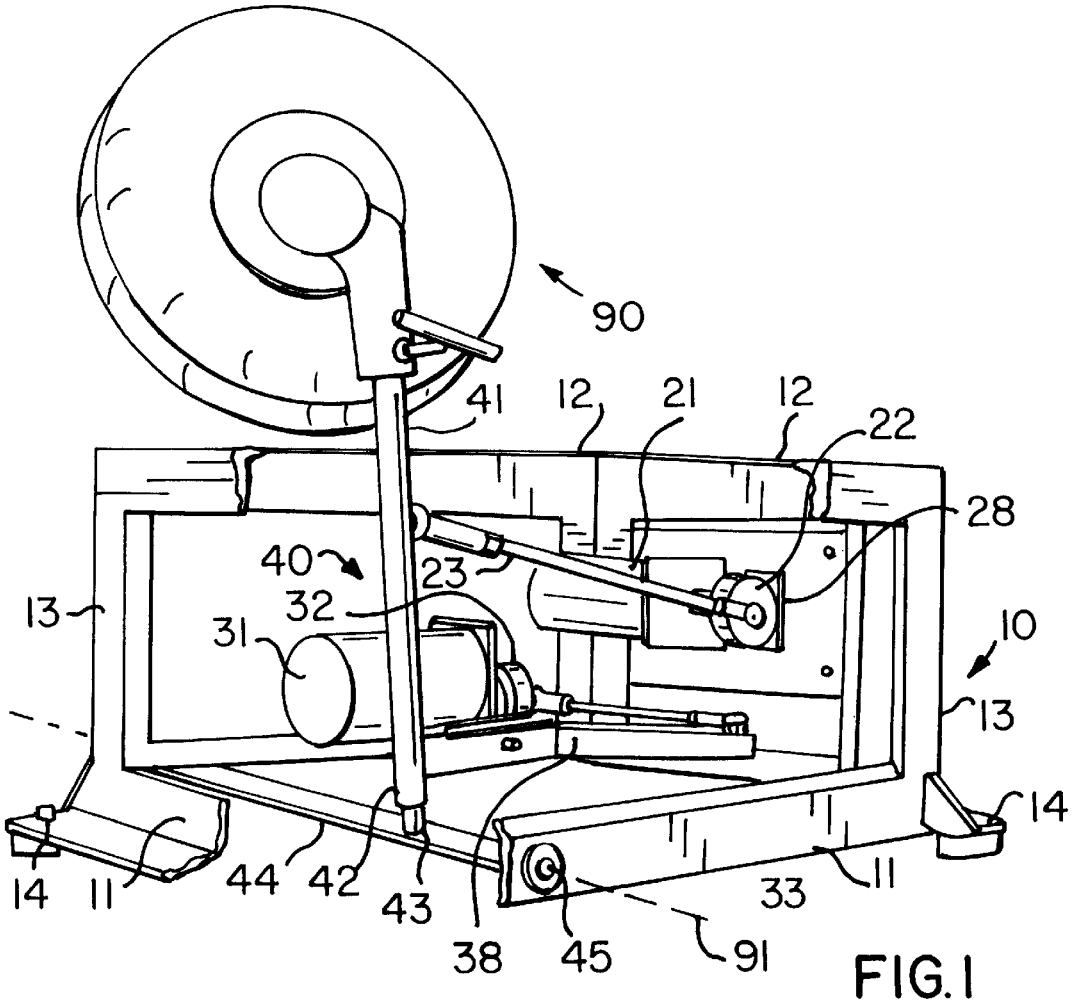
FIG. 1 is a perspective view of a preferred embodiment of the invention showing an open base member, with a corner of the base member removed to expose other components, and a ball pitching means mounted onto the mounting post.
Figure 2:
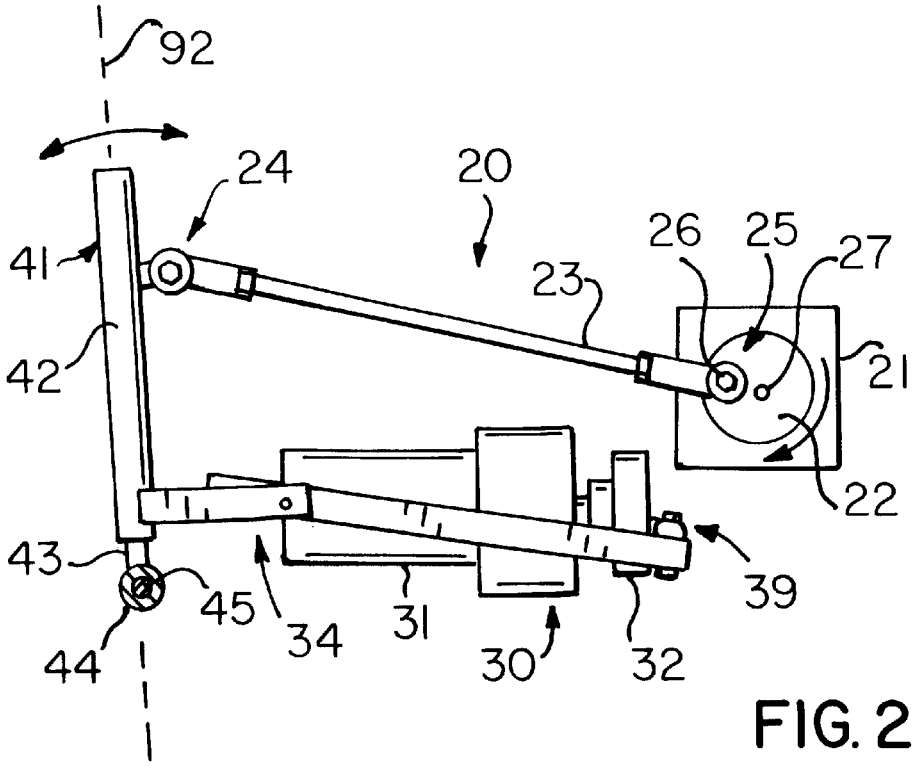
FIG. 2 is a side view of the tilting means, rotation means and mounting post.

With reference now to FIGS. 1 and 2, the main components of the invention are illustrated. The invention comprises in general support or base member 10, means 20 for titling a pitching machine and varying the trajectory of the pitched ball, and means 30 for rotating a pitching machine and varying the direction of the pitched ball, with the mount adapted to support a ball pitching machine means 90. The ball pitching machine means 90 may comprise any apparatus capable of delivering a softball or baseball to simulate the throw of a pitcher into a target zone, and such apparatuses are well known in the field. As shown, the typical ball pitching means 90 is constructed to be mounted onto a vertical post, and such construction is utilized in the description herein, but it is contemplated that any other suitable mounting mechanism may be substituted without departing from the spirit of the invention. Ball pitching means 90 is preferably of the type which utilizes one or two rubber or polymer wheels which are rotated to project the ball in essentially the same direction and trajectory each pitch, such as the pitching machines sold under the brand JUGS for example. The pitching machine means 90 may be permanently affixed or temporarily affixed to the base member 10.

The base member 10 is shown as an open framework, but base member 10 may also comprise an enclosed housing. As shown in FIG. 1, base member 10 comprises bottom members 11, top members 12 and corner members 13 joined to define a rectangular support for the other components of the invention. Preferably, the base member 10 is provided with feet 14, and optionally wheels (not shown) may be attached to the base member 10 such that the device can be tilted to bring the wheels into contact with the ground for ease in relocating the device. The base member 10 is shown as composed mainly of angle iron, but any suitably strong material may be used, and other structural configurations are possible as the main purpose of the base member is to provide support for the pitching means 90 and to serve as a frame for mounting the operational components of the invention.

Means 40 for mounting the pitching machine means 90 is positioned within the support base 10. The mounting means 40 is constructed such that the pitching machine means 90 can be tilted front to back about a horizontal pivot axis 91 such that the balls will be projected with a higher or lower trajectory, and also such that the pitching machine means 90 can be rotated left and right about a vertical pivot axis 92 such that the balls will be projected in different directions into the target zone. The mounting means 40 comprises a mounting post 41 which extends a distance above the top members 12 of the base member 10 so that the pitching machine means 90 can be mounted thereon with sufficient clearance for the tilting and rotating action. The mounting post 41 comprises a tubular sleeve member 42 coaxially disposed on an inner rod member 43, which may be solid or tubular. The inner rod member 43 is perpendicularly joined to a horizontal shaft member 44. Sleeve member 42 is free to rotate relative to the inner rod member 43, and the pitching machine means 90 is connected to the sleeve member 42 such that rotation of the sleeve member 42 is transferred to the pitching machine means 90. Such action varies the pitching direction to the left and right. The horizontal shaft member 44 is mounted within base member 10 such that it is free to rotate about its central axis, which is the horizontal pivot axis 91. As shown, shaft member 44 is a tubular member coaxially mounted onto a mounting pin member 45 which extends between opposing bottom members 11 perpendicular to the pitching direction of the pitching machine means 90. Rotation of the shaft member 44 translates into a tilting motion for mounting post 41 and pitching machine means 90. Such action varies the trajectory of the pitching machine means 90.

Figure 5:
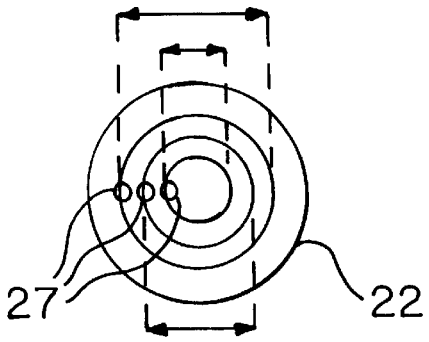
FIG. 5 is an end view of a crank wheel showing the eccentrically disposed tie rod connection apertures.
Figure 3:
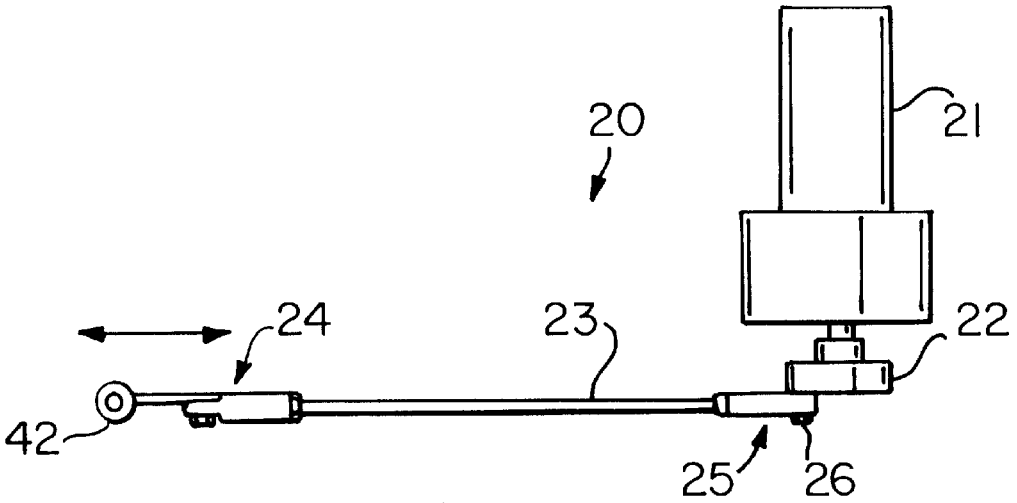
FIG. 3 is a top view of the tilting means.

Means 20 for tilting the pitching machine means 90 about a horizontal pivot axis 91 and varying the trajectory of the pitched ball are mounted within the base member 10 and are illustrated in FIGS. 1 through 3, and comprise motor means 21 for rotating a tilt crank wheel 22 to which is connected a tilt tie rod member 23. Motor means 21 may be any suitable power delivery unit, and as shown preferably comprises an electric motor mounted on shock absorbing members and powering a rotating shaft to which is attached the tilt crank wheel 22. Tilt crank wheel 22 may be coaxially mounted as shown or eccentrically mounted to the motor means 21. The tilt crank wheel 22 may also be replaced by a cam assembly or other mechanism for varying the stroke length of the tie rod member 23. The tilt tie rod member 23 is connected to the mounting post 41 by pivoting connection means 24 which also allows for limited rotation of the sleeve 42 relative to the tilt tie rod member 23 at the point of connection. The tilt crank wheel 22 is oriented such its axis of rotation is perpendicular to the vertical direction plane, and is preferably backed by thrust block 28 having a curved surface which abuts the curved wall of the tile crank wheel 22 to preclude movement of the tilt crank wheel 22 away from the mounting post 41. The tilt tie rod member 23 is mounted eccentrically to the tilt crank wheel 22 by tie rod connection means 25, which may comprise a threaded bolt 26 mated with internally threaded bores 27 disposed at varying distances from the central axis of the tilt crank wheel 22, as seen best in FIG. 5. As the tilt crank wheel 22 is rotated, the mounting post tilts forward and backward on the rotating horizontal shaft 44. Where the outmost bore 27 is utilized, the stroke length of the tilt tie rod member 23 and therefore the range of tilt for the mounting post 41 is maximized, resulting in the largest variation in height of the pitched balls and the tallest target zone. Where the innermost bore 27 is utilized, the stroke length of the tilt tie rod member 23 and the range of tilt for the mounting post 41 is minimized, resulting in the smallest variation in height of the pitched balls and the smallest target zone. The ability to vary the trajectory of the pitched balls allows the device to account for differing pitching distances and to allow the range of pitches to be predetermined for the particular practice purpose being employed. Tilt tie rod members 23 of adjustable length may also be utilized to provide for even more precise control of the trajectory range.

Figure 4:
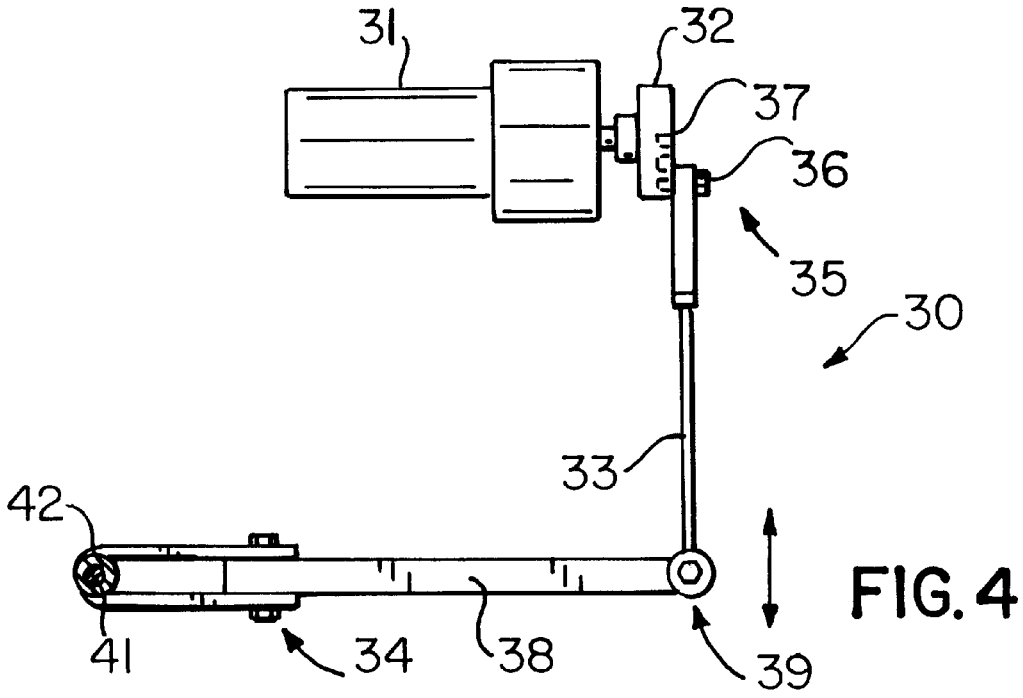
FIG. 4 is a top view of the rotation means.

Means 30 for rotating the pitching machine means 90 about a vertical pivot axis 92 and varying the direction of the pitched ball are mounted within the base member 10, as illustrated in FIGS. 1, 2 and 4, and comprise motor means 31 for rotating a rotation crank wheel 32 to which is connected a rotation tie rod member 33. Motor means 31 may be any suitable power delivery unit, and as shown preferably comprises an electric motor powering a rotating shaft to which is attached the crank wheel 32. Rotation crank wheel 32 may be coaxially mounted as shown or eccentrically mounted to the motor means 31. The rotation crank wheel 32 may also be replaced by a cam assembly or other mechanism for varying the stroke length of the tie rod member 33. The rotation tie rod member 33 is pivotally connected to a transfer arm 38 at approximately 90 degrees by transfer arm connection means 39, and the transfer arm 38 is connected to the sleeve member 42 of mounting post 41 by pivoting connection means 34. The rotation crank wheel 32 is oriented such its axis of rotation is parallel to the vertical direction plane. The rotation tie rod member 33 is mounted eccentrically to the rotation crank wheel 32 by tie rod connection means 35, which may comprise a threaded bolt 36 mated with internally threaded bores 37 disposed at varying distances from the central axis of the rotation crank wheel 32, in manner similar to FIG. 5. As the rotating crank wheel 32 is rotated, rotation tie rod member 33 oscillates transfer arm 38 left and right relative to the pitching direction, which in turn rotates sleeve member 42 about rod member 43, thereby varying the pitching direction of pitching machine means 90. Where the outmost bore 37 is utilized, the stroke length of the rotation tie rod member 33 and therefore the range of rotation for the mounting post 41 is maximized, resulting in the largest variation in direction of the pitched balls and the widest target zone. Where the innermost bore 37 is utilized, the stroke length of the rotation tie rod member 33 and the range of rotation for the mounting post 41 is minimized, resulting in the smallest variation in direction of the pitched balls and the narrowest target zone. The ability to vary the direction of the pitched balls allows the range of direction of pitches to be predetermined for the particular practice purpose being employed. Rotation tie rod members 33 of adjustable length may also be utilized to provide for even more precise control of the direction range. The rotation means 30 operates independently of the tilting means 20.

In an alternative embodiment, the motor means 31 and rotation crank wheel 32 may be mounted with the axis of rotation extending vertically, in which case the rotation tie rod member 33 can be directly connected to the sleeve member 42 of the mounting post 41 such that rotation of the rotation crank wheel 32 causes rotation of the sleeve member 42 of mounting post 41.

The bores 27 and 37 on crank wheels 22 and 32 are preferably disposed at intervals between 0.25 inches to 1.5 inches from the central axis of the crank wheels 22 and 32. This provides a stroke length for the tie rod members 23 and 33 from 0.5 inches to 3 inches, and this has been shown suitable to account for different pitching distances, which may vary from 35 to 40 to 43 feet for softball, for example, for typical maximum target zone height, and for typical maximum target zone width. Maximum tilting and rotation variations in the range of 2 to 3 degrees are sufficient to provide for typical desired trajectory and direction ranges. It is preferred that the overall height of the invention be equivalent to the height of the standard fixed tripods commonly used to support pitching machine means 90, so that the delivery point of the pitched ball will be approximately equal when the pitching machine means 90 are mounted onto the mounting post 41 of the invention.

Figure 6:
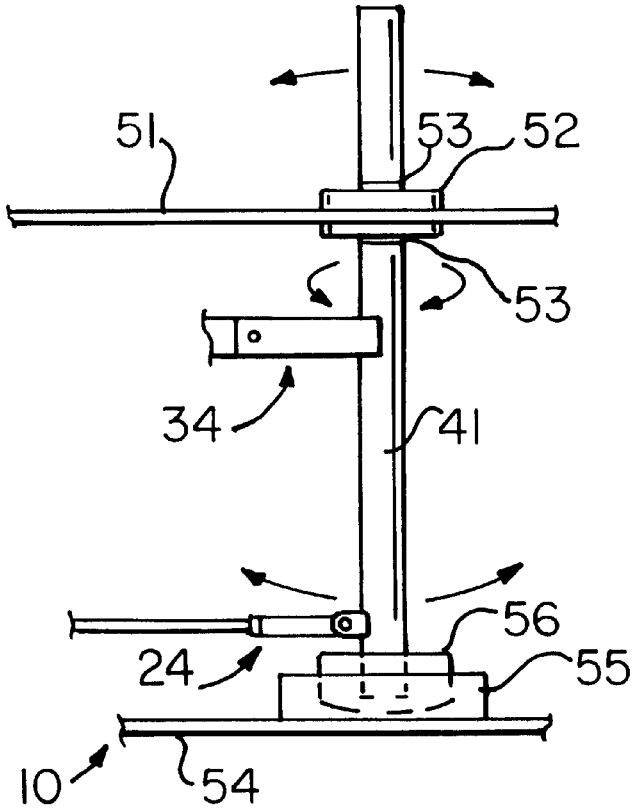
FIG. 6 is a partial side view of an alternative embodiment of the invention.

An alternative embodiment for the invention is shown in FIG. 6. In this construction, the base member 10 comprises a top plate member 51 and a bottom plate member 54. The mounting post 41 extends through a pivoting connector means 52, such as a spherical bearing, mounted onto the top plate 51 and is restrained from vertical movement by snap rings 53. The mounting post 41 can be a rod or a tube, or may comprise a sleeve member 42 coaxially mounted onto a rod member 43, and terminates within the vertical bore of a sliding block 56 preferably formed of a hard polymer with low friction characteristics, such as PTFE. The mounting post 41 is free to rotate within the bore of the sliding block 56. In this construction, the tilting means 20 is attached to the mounting post 41 near its bottom while the rotating means 30 is attached to the mounting post 41 at a higher point. The sliding block 56 is limited laterally by a pair of guide rails 55 which allow movement only in the pitching direction. Whereas in the embodiment shown in FIGS. 1 and 2 the mounting post 41 pivots at its base on horizontal shaft member 44, in the embodiment of FIG. 6 the mounting post 41 pivots at the pivoting connector means 52 on the upper portion of the mounting post 41, the horizontal pivot axis 91 passing through the pivoting connector means 52. This embodiment is better suited for use in pitching baseballs as opposed to softballs, because the pitching distance is much greater for baseball and therefore less tilting is required about the horizontal axis to vary the pitch within the desired target zone. This design allows for finer variation in the tilting parameters, since the tilt crank wheel 22 can remain relatively large, providing a larger surface for disposition of the bores 27 to adjust the target range vertically.

It is contemplated that equivalents and substitutions for certain elements described above may be obvious to those skilled in the art, and therefore the true scope and definition of the invention is to be as set froth in the following claims.

I claim:

1. A mount device for a ball pitching machine, said mount comprising:

a base member and a mounting post adapted to support a ball pitching machine;

tilting means to tilt said ball pitching machine about a horizontal pivot axis to vary the trajectory of balls delivered by said ball pitching machine, said tilting means mounted to said base member;

rotating means to rotate said ball pitching machine about a vertical pivot axis to vary the direction of balls delivered by said ball pitching machine, said rotating means mounted to said base member, wherein said rotating means operates independently of said tilting means;

wherein said tilting means and said rotating means are powered such that said ball pitching machine is tilted and rotated automatically and randomly.

2. The device of claim 1, wherein said mounting post comprises a sleeve member coaxially mounted onto a rod member, said rod member being connected to a pivoting horizontal shaft member connected to said base member, and said sleeve member being rotatable relative to said rod member, such that said horizontal pivot axis passes through said horizontal shaft member.

3. The device of claim 2, wherein said tilting means comprises a motor means, a tilt crank wheel connected to said motor and rotated thereby, and a tilt tie rod connected to said mounting post and eccentrically to said tilt crank wheel, such that rotation of said tilt crank wheel causes said mounting post to pivot about said horizontal pivot axis.

4. The device of claim 3, wherein said rotating means comprises a motor means, a rotation crank wheel connected to said motor and rotated thereby, a transfer arm connected to said mounting post, and a rotation tie rod connected to said transfer arm and eccentrically to said rotation crank wheel, such that rotation of said rotation crank wheel causes said mounting post to rotate about said vertical pivot axis.

5. The device of claim 4, further comprising a plural number of bores disposed on said tilt crank wheel, such that the amount of tilt can be varied by connecting said tilt tie rod member to different bores, and further comprising a plural number of bores disposed on said rotation crank wheel, such that the amount of rotation can be varied by connecting said rotation tie rod member to different bores.

6. The device of claim 3, further comprising a plural number of bores disposed on said tilt crank wheel, such that the amount of tilt can be varied by connecting said tilt tie rod member to different bores.

7. The device of claim 2, wherein said rotating means comprises a motor means, a rotation crank wheel connected to said motor and rotated thereby, a transfer arm connected to said mounting post, and a rotation tie rod connected to said transfer arm and eccentrically to said rotation crank wheel, such that rotation of said rotation crank wheel causes said mounting post to rotate about said vertical pivot axis.

8. The device of claim 7, further comprising a plural number of bores disposed on said rotation crank wheel, such that the amount of rotation can be varied by connecting said rotation tie rod member to different bores.

9. The device of claim 1, wherein said base member comprises a top plate and a bottom plate, and wherein a pivoting connector means is mounted to said top plate and said mounting post extends through said pivoting connector means and is rotatably connected to a sliding block retained within a pair of guide rails affixed to said bottom plate, such that said horizontal pivot axis passes through said pivoting connector means.

10. The device of claim 9, wherein said tilting means comprises a motor means, a tilt crank wheel connected to said motor and rotated thereby, and a tilt tie rod connected to said mounting post and eccentrically to said tilt crank wheel, such that rotation of said tilt crank wheel causes said mounting post to pivot about said horizontal pivot axis.

11. The device of claim 10, further comprising a plural number of bores disposed on said tilt crank wheel, such that the amount of tilt can be varied by connecting said tilt tie rod member to different bores.

12. The device of claim 9, wherein said rotating means comprises a motor means, a rotation crank wheel connected to said motor and rotated thereby, a transfer arm connected to said mounting post, and a rotation tie rod connected to said transfer arm and eccentrically to said rotation crank wheel, such that rotation of said rotation crank wheel causes said mounting post to rotate about said vertical pivot axis.

13. The device of claim 12, further comprising a plural number of bores disposed on said rotation crank wheel, such that the amount of rotation can be varied by connecting said rotation tie rod member to different bores.

14. The device of claim 9, wherein said rotating means comprises a motor means, a rotation crank wheel connected to said motor and rotated thereby, a transfer arm connected to said mounting post, and a rotation tie rod connected to said transfer arm and eccentrically to said rotation crank wheel, such that rotation of said rotation crank wheel causes said mounting post to rotate about said vertical pivot axis; and wherein said tilting means comprises a motor means, a tilt crank wheel connected to said motor and rotated thereby, and a tilt tie rod connected to said mounting post and eccentrically to said tilt crank wheel, such that rotation of said tilt crank wheel causes said mounting post to pivot about said horizontal pivot axis.

15. The device of claim 14, further comprising a plural number of bores disposed on said tilt crank wheel, such that the amount of tilt can be varied by connecting said tilt tie rod member to different bores, and further comprising a plural number of bores disposed on said rotation crank wheel, such that the amount of rotation can be varied by connecting said rotation tie rod member to different bores.

16. A ball pitching machine device comprising:

ball pitching means to deliver a ball in a particular trajectory and direction;

a base member and a mounting post adapted to support said ball pitching means;

tilting means to tilt said ball pitching means about a horizontal pivot axis to vary the trajectory of balls delivered by said ball pitching means, said tilting means mounted to said base member;

rotating means to rotate said ball pitching means about a vertical pivot axis to vary the direction of balls delivered by said ball pitching means, said rotating means mounted to said base member, wherein said rotating means operates independently of said tilting means;

wherein said tilting means and said rotating means are powered such that said ball pitching means is tilted and rotated automatically and randomly.

17. The device of claim 16, wherein said mounting post comprises a sleeve member coaxially mounted onto a rod member, said rod member being connected to a pivoting horizontal shaft member connected to said base member, and said sleeve member being rotatable relative to said rod member, such that said horizontal pivot axis passes through said horizontal shaft member;

wherein said tilting means comprises a motor means, a tilt crank wheel connected to said motor and rotated thereby, and a tilt tie rod connected to said mounting post and eccentrically to said tilt crank wheel, such that rotation of said tilt crank wheel causes said mounting post to pivot about said horizontal pivot axis; and wherein said rotating means comprises a motor means, a rotation crank wheel connected to said motor and rotated thereby, a transfer arm connected to said mounting post, and a rotation tie rod connected to said transfer arm and eccentrically to said rotation crank wheel, such that rotation of said rotation crank wheel causes said mounting post to rotate about said vertical pivot axis.

18. The device of claim 17, further comprising a plural number of bores disposed on said tilt crank wheel, such that the amount of tilt can be varied by connecting said tilt tie rod member to different bores, and further comprising a plural number of bores disposed on said rotation crank wheel, such that the amount of rotation can be varied by connecting said rotation tie rod member to different bores.

19. The device of claim 16, wherein said base member comprises a top plate and a bottom plate, and wherein a pivoting connector means is mounted to said top plate and said mounting post extends through said pivoting connector means and is rotatably connected to a sliding block retained within a pair of guide rails affixed to said bottom plate, such that said horizontal pivot axis passes through said pivoting connector means;

wherein said rotating means comprises a motor means, a rotation crank wheel connected to said motor and rotated thereby, a transfer arm connected to said mounting post, and a rotation tie rod connected to said transfer arm and eccentrically to said rotation crank wheel, such that rotation of said rotation crank wheel causes said mounting post to rotate about said vertical pivot axis; and wherein said tilting means comprises a motor means, a tilt crank wheel connected to said motor and rotated thereby, and a tilt tie rod connected to said mounting post and eccentrically to said tilt crank wheel, such that rotation of said tilt crank wheel causes said mounting post to pivot about said horizontal pivot axis.

20. The device of claim 19, further comprising a plural number of bores disposed on said tilt crank wheel, such that the amount of tilt can be varied by connecting said tilt tie rod member to different bores, and further comprising a plural number of bores disposed on said rotation crank wheel, such that the amount of rotation can be varied by connecting said rotation tie rod member to different bores.

* * * * *